US007332533B2

(12) United States Patent
Kim et al.

(10) Patent No.: US 7,332,533 B2
(45) Date of Patent: Feb. 19, 2008

(54) GOLF BALLS INCORPORATING NANOFILLERS AND METHODS FOR MAKING SUCH GOLF BALLS

(75) Inventors: Hyun Jin Kim, Carlsbad, CA (US); Kelvin Tsugio Okamoto, Carlsbad, CA (US); Hong Guk Jeon, Carlsbad, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 102 days.

(21) Appl. No.: 10/926,509

(22) Filed: Aug. 25, 2004

(65) Prior Publication Data

US 2005/0059756 A1 Mar. 17, 2005

Related U.S. Application Data

(63) Continuation-in-part of application No. 09/627,591, filed on Jul. 28, 2000, now Pat. No. 6,794,447.

(51) Int. Cl.
*A63B 37/00* (2006.01)

(52) U.S. Cl. ..... 523/216; 523/209; 523/212; 524/445; 524/449; 524/451; 473/371; 473/372; 473/374; 473/377; 473/378; 473/385

(58) Field of Classification Search ..... None
See application file for complete search history.

(56) References Cited

U.S. PATENT DOCUMENTS

| | | | | |
|---|---|---|---|---|
| 4,692,497 | A * | 9/1987 | Gendreau et al. | 525/263 |
| 4,894,411 | A | 1/1990 | Okada et al. | |
| 5,385,776 | A | 1/1995 | Maxfield et al. | |
| 5,779,561 | A | 7/1998 | Sullivan et al. | |
| 5,810,677 | A | 9/1998 | Maruko et al. | |
| 5,810,678 | A * | 9/1998 | Cavallaro et al. | 473/373 |
| 5,833,553 | A | 11/1998 | Sullivan et al. | |
| 5,962,553 | A | 10/1999 | Ellsworth | |
| 6,012,991 | A | 1/2000 | Kim et al. | |
| 6,060,549 | A | 5/2000 | Li et al. | |
| 6,117,025 | A | 9/2000 | Sullivan | |
| 6,162,135 | A * | 12/2000 | Bulpett et al. | 473/373 |
| 6,203,451 | B1 | 3/2001 | Rajagopalan | |
| 6,794,447 | B1 | 9/2004 | Kim et al. | |
| 2003/0130061 | A1 | 7/2003 | Rajagopalan et al. | |
| 2003/0229183 | A1 | 12/2003 | Voorheis et al. | |
| 2004/0230005 | A1 * | 11/2004 | Voorheis et al. | 525/256 |
| 2005/0020385 | A1 | 1/2005 | Onoda et al. | |

FOREIGN PATENT DOCUMENTS

| | | | |
|---|---|---|---|
| WO | WO 93/11190 | * | 6/1993 |
| WO | WO 02/09823 | * | 2/2002 |

OTHER PUBLICATIONS

Destefani, James D., "Small But Mighty," *Molding Systems*, Oct. 1999, pp. 32, 34-46.
Technical Data, General Information About Nanomers, Nanocor, 2 pages.
Encyclopedia of Chemical Technology. 1993, vol. 6, pp. 415-418.
Encyclopedia of Polymer Science and Engineering. 1988. vol. 7, pp. 54-55.

* cited by examiner

*Primary Examiner*—David J. Buttner
(74) *Attorney, Agent, or Firm*—Sheppard, Mullin, Richter & Hampton LLP

(57) ABSTRACT

A golf ball incorporates nanofiller material in its core, cover, or intermediate layers. Also, a method includes a step of blending into a composition for a golf ball nanocomposite material, nanofiller material or both. The nanocomposite and/or nanofiller materials impart favorable properties to materials used for golf balls, and they provide for greater versatility in usage than materials previously used. Particular compositions incorporating nanocomposite material also are described as suited for use in golf ball compositions.

22 Claims, 1 Drawing Sheet

GOLF BALLS INCORPORATING NANOFILLERS AND METHODS FOR MAKING SUCH GOLF BALLS

CROSS REFERENCE TO RELATED APPLICATIONS

This is a continuation-in-part of U.S. application Ser. No. 09/627,591, filed Jul. 28, 2000, now U.S. Pat. No. 6,794, 447, the entire contents of which are herein incorporated by reference.

BACKGROUND OF THE INVENTION

This invention relates generally to golf ball compositions and methods for making golf balls from these compositions. The compositions are formulated to optimize the golf balls' performance properties.

Golf balls generally comprise a core and at least one cover layer surrounding the core. Balls can be classified as two-piece, multi-layer, or wound balls. Two-piece balls include a spherical inner core and an outer cover layer. Multi-layer balls include a core, a cover layer, and one or more intermediate layers. Wound balls include a core, a rubber thread wound under tension around the core to a desired diameter, and a cover layer, typically of balata material. Generally, two-piece balls have good ball distance when hit and durability, but poor "feel"—the overall sensation transmitted to the golfer while hitting the ball—and low spin rate, which results in poor ball control. Wound balls having balata covers generally have high spin rate, leading to good control, and good feel, but they have short distance and poor durability in comparison to two-piece balls. Multi-layer balls generally have performance characteristics between those of two-piece and wound balls; that is, multi-layer balls exhibit distance and durability inferior to two-piece balls but superior to wound balata balls, and they exhibit feel and spin rate inferior to wound balata balls but superior to two-piece balls.

Material characteristics of the compositions used in the core, cover, and any intermediate layers are among the important factors that determine the performance of the resulting golf balls. In particular, the composition of the core is important in determining the core's coefficient of restitution (C.O.R.) and compression ratios, which are important factors in determining the ball's speed. Further, the composition of intermediate layers in multi-layer balls is important in determining the ball's spin rate and controllability. Finally, the composition of the cover layer is important in determining the ball's durability, scuff resistance, speed, shear resistance, spin rate, "click" (the sound made by a golf club head when it hits the ball), and feel.

Various materials having different physical properties are used to make core, cover and intermediate layers to create a ball having the most desirable performance possible. For example, many modem cover and intermediate golf ball layers are made using soft or hard ionomeric resins, elastomeric resins, or blends of these. Ionomeric resins used generally are ionic copolymers of an olefin and a metal salt of a unsaturated carboxylic acid, or ionomeric terpolymers having a co-monomer within its structure. These resins vary in resiliency, flexural modulus, and hardness. Examples of these resins include those marketed under the name SURLYN manufactured by E.I. du Pont de Nemours Company of Wilmington, Del., and IOTEK manufactured by Exxon Mobil Corporation of Irving, Texas. Elastomeric resins used in golf balls include a variety of thermoplastic or thermoset elastomers available. Ball cores generally are made from polybutadiene rubbers.

Each of the materials discussed above has particular characteristics that can lead to good golf ball properties. However, one material generally cannot optimize all of the important properties of a golf ball. Properties such as feel, spin rate, resilience, and durability all are of importance, but improvement of one of these properties by use of a particular material often can lead to worsening of another. For example, ideally, a golf ball cover should have low hardness, high spin rate, and good feel, without sacrificing ball speed, distance, or durability. Such a cover would be difficult to make using only an ionomer resin having a high flexural modulus, because the resulting cover, while having good distance and durability, also will have poor feel and low spin rate, leading to reduced controllability of the ball.

To try to improve golf ball properties, some of the materials discussed above can be blended to produce golf ball cores, intermediate layers, or cover layers. As discussed above, ideally a golf ball cover should provide a proper spin rate and good feel, without sacrificing the ball's distance and durability. Therefore, an ionomer having a high flexural modulus often is combined in a cover composition with an ionomer or elastomer having a low flexural modulus. The resulting intermediate-modulus blend will have acceptable hardness, spin, and durability. In addition to the above materials, golf ball compositions also can include various fillers, fibers, colorants, and processing aids to impart additional desirable mechanical or cosmetic properties to the golf ball. An example of use of fibers in an intermediate layer of a golf ball is described in U.S. Pat. No. 6,012,991 to Kim et al. The fiber material described in that patent is added to intermediate layer compositions to enhance their hardness.

However, even with blending of materials to improve properties, use of the materials discussed above is not completely satisfactory. Improving one characteristic can lead to worsening another. For example, blending an ionomer having a high flexural modulus with an ionomer having a low flexural modulus can lead to reduced resilience and durability compared to use of the high-modulus ionomer alone. In general, it is difficult to make a material for an intermediate or cover layer for a golf ball that has low hardness, good feel, high speed, high resilience, and good shear durability. Similar difficulties exist in optimizing ball core properties.

In view of the above, it is apparent that materials are needed for use in making golf balls that allow the optimization of many ball performance properties without the worsening of other properties. The material also preferably should provide little or no added processing difficulties. The present invention fulfills this need and other needs, and provides further related advantages.

SUMMARY OF THE INVENTION

The present invention is embodied in a golf ball including a core, an outer cover layer and, optionally, one or more intermediate layers between the outer cover and the core, and wherein one or more of the core, outer cover layer, or intermediate layers, includes a mixture of a thermoplastics or thermoset matrix polymer and combinations thereof and one or more nanofillers substantially dispersed in the thermoplastic or thermoset matrix polymer.

More particularly, the nanofiller is present in the thermoplastic or thermoset polymer in an amount of about 0.1% to 20%, preferably from 0.1% to 15%, even more preferably from about 0.1% to 10%, and most preferably from about 0.5% to 5% by weight.

Even more particularly, the nanofiller is dispersed in the thermoplastic or thermoset matrix polymer in an intercalated or exfoliated manner.

In a more detailed feature of the invention the nanofiller comprises particles of inorganic material having a largest dimension that is about one micron or less and that is at least an order of magnitude greater than such particle's smallest dimension.

In a further feature of the invention the thermoplastic matrix polymer, if present, is selected from the group consisting of polyamide, ionomer, polycarbonate, thermoplastic polyurethane, polystyrene, polyoctenylene, fluoropolymer, polyamide, polyamide elastomer, polyester elastomer, polyester, polyolefin, ethylene copolymers with (meth)acrylic acid, ethylene terpolymers with (meth)acrylic acid and (meth)acrylate esters, thermoplastic elastomer, thermoplastic vulcanizate, epoxy resin, and mixtures thereof; or the thermoset matrix polymer, if present, is selected from the group consisting of thermoset polyurethane, epoxy resin, and mixtures thereof.

More particularly if the thermoplastic elastomer is a block copolymer, it includes a first polymer block comprising an aromatic vinyl compound; and a second polymer block comprising a conjugated diene compound.

More particularly if the thermoplastic elastomer is the hydrogenation product of a block copolymer, it includes a first polymer block comprising an aromatic vinyl compound; a second polymer block comprising a conjugated diene compound; and a functional group located at a terminal block copolymer.

Even more particularly if the thermoplastic elastomer is the hydrogenation product of a block copolymer, it includes polymer end blocks comprising an aromatic vinyl compound; a middle polymer block comprising a conjugated diene compound; and hydroxyl groups located at a terminal block copolymer.

In another embodiment of the present invention the thermoplastic elastomer may be blended with a polymer selected from the group consisting of polyamide, polyamide elastomer, polyurethane, ionomer, polyolefin, ethylene copolymers with (meth)acrylic acid and ethylene terpolymers with (meth)acrylic acid and (meth)acrylate esters, and combinations thereof.

More particularly the nanofiller includes a clay, and even more particularly the clay is selected from the group consisting of hydrotalcite, montmorillonite, phyllosilicate, saponite, hectorite, beidellite, stevensite, vermiculite, halloysite, mica, micafluoride, and octosilicate.

In another embodiment of the present invention the golf ball core includes an inner core; and an outer core encasing the inner core.

In another embodiment of the present invention the golf ball core includes a material in liquid form.

In another embodiment of the present invention the golf ball core further includes, a layer of rubber thread located between the core and a cover layer.

In another embodiment of the present invention the golf ball core is from about 0.8 to about 1.62 inches in diameter, has a specific gravity from about 1.0 to 1.3, or has an Atti compression from about 30 to 100, and/or a hardness from about 20 to about 80 Shore D.

In further embodiments of the present invention, the golf ball cover has a thickness of about 0.020 to about 0.10 inch, and/or a hardness as measured on the ball from about 40 to about 80 Shore D, and/or a specific gravity from about 0.90 to about 1.25.

In another embodiment of the present invention the golf ball compression is from about 70 to about 100.

In another embodiment of the present invention the golf ball includes a core, at least one intermediate layer over the core; and an outer cover layer; and where at least one of the core, the at least one intermediate layer, or the outer cover layer includes a thermoplastic or thermoset matrix polymer; and one or more nanofillers which is substantially dispersed in the matrix polymer.

More particularly, the golf ball core is from about 0.8 to about 1.55 inches in diameter, and/or has a specific gravity from about 1.0 to 1.3, and/or has an Atti compression from about 30 to 100, and/or has a hardness from about 20 to about 80 Shore D.

Also, the golf ball outer cover layer has a thickness of from about 0.020 to about 0.10 inch, and/or a hardness as measured on the ball of from about 40 to about 80 Shore D, and/or a specific gravity from about 0.90 to about 1.25.

Also, at least one intermediate layer is from about 0.020 to about 0.30 inch thick, and/or has a material hardness from about 35 to about 80 Shore D, and/or has a specific gravity of 0.90 to about 1.20.

In another embodiment, at least one of the outer cover layer and the at least one intermediate layer comprises ionomer, thermoplastic elastomer, thermoplastic vulcanizate, polyamide, or mixtures thereof.

In another embodiment, at least one of the outer cover layer and the at least one intermediate layer comprises an ionomer containing fatty acid or the metal salts thereof.

In another embodiment, at least one of the outer cover layer and the at least one intermediate layer comprises a bimodal ionomer.

In another embodiment, at least one of the outer cover layer and the at least one intermediate layer comprises thermoplastic or thermoset polyurethane.

In another embodiment, the core composition comprises an unsaturated polymer such as 1,2-polybutadiene, cis-1,4-polybutadiene, trans-1,4-polybutadiene, cis-polyisoprene, polyoctenylene, trans-polyisoprene, polychloroprene, polybutylene, styrene-butadiene rubber, block copolymer of styrene and butadiene, block copolymer of styrene and isoprene, nitrile rubber, silicone rubber, polyurethane, and mixtures thereof.

In another embodiment, the core composition further comprises a cross-linking agent.

Further the core composition includes from about 0.05 parts to about 5 parts by weight, preferably from about 0.25 parts to about 2 parts by weight of the cross-linking agent per 100 parts by weight of the unsaturated polymer.

Further, the cross-linking agent comprises organic peroxide, inorganic peroxide, or mixtures thereof.

More particularly, the cross-linking agent comprises at least one organic peroxide.

Even more particularly the cross-linking agent comprises at least one organic peroxide with a $T_{1/2}$ at 1/10 hour less than 150 deg C. and at least one organic peroxide with a $T_{1/2}$ at 1/10 hour greater than 150 deg C.

In another embodiment, the core composition further comprises one or more peptizers.

Further, the core composition includes greater than about 0.1 parts by weight, preferably greater than about 0.5 part by weight of the peptizer per 100 parts by weight of the unsaturated polymer.

More particularly, the peptizer is selected from a group consisting of pentachlorothiophenol, a metal salt of pentachlorothiophenol, a non-metal salt of pentachlorothiophenol, and dibenzamido diphenyldisulfide.

Even more particularly the peptizer is selected from a group consisting of an amine salt of pentachlorothiophenol, an ammonium salt of pentachlorothiophenol, and mixtures thereof.

In another embodiment, the core composition further comprises an accelerator.

Further, the core composition includes from about 0.1 part to about 10 parts by weight of the accelerator per 100 parts by weight of the unsaturated polymer, and wherein the accelerator is selected from a group consisting of 2-mercaptobenzothiazole, a salt of 2-mercaptobenzothiazole and combinations thereof.

In another embodiment, the core composition further comprises an ingredient selected from a group consisting of UV stabilizers, photo stabilizers, antioxidants, colorants, dispersants, mold releasing agents, processing aids, and fillers.

More particularly, when the ingredient is a filler it selcted from zinc oxide, tungsten, barium sulfate, and mixtures thereof.

In another embodiment, the core composition further comprises a co-cross linking agent selected from a group consisting of an unsaturated carboxylic acid, a metal salt of the unsaturated carboxylic acid, and mixtures thereof.

Further, the composition includes from about 20 parts to about 60 parts by weight of the a co-cross linking agent per 100 parts by weight of the unsaturated polymer.

Further, the golf ball has a compression from about 70 to about 100.

In another embodiment, the core of the golf balls of the present invention include a center and one or more layers disposed around the center and wherein the difference between a hardness of one layer and the next adjacent layer is greater than 2, preferably greater than 5, most preferably greater than 10 units of Shore D.

Further, the hardness may increases or decrease outwards form core to outer core layer.

In another embodiment, the present invention includes a method for making a composition for use in golf balls, including a step of mixing a nanofiller with a polymer; where the nanofiller is present in an amount of about 0.1 part to about 10 parts by weight per 100 parts by weight of the polymer(s), preferably the nanofiller is present in an amount of from about 0.1% to 20% by weight, more preferably 0.1% to 15% by weight, even more preferably from about 0.1% to 10% by weight, and most preferably from about 0.5% to 5% by weight, and is substantially dispersed in the polymer.

In another embodiment of the method of the present invention, the nanofiller is intercalated or exfoliated within the polymer.

In another embodiment of the method of the present invention, the nanofiller comprises particles of inorganic material, wherein each particle has a largest dimension that is about one micron or less and that is at least an order of magnitude greater than such particle's smallest dimension.

In another embodiment of the method of the present invention, the polymer is selected from the group consisting of polyamide, ionomer, polycarbonate, polyurethane, polystyrene, fluoropolymer, polyamide elastomer, polyester elastomer, polyester, polyolefin including ethylene copolymers with (meth)acrylic acid and (meth)acrylate esters, thermoplastic elastomer, thermoplastic vulcanizate, and epoxy resin, and mixtures thereof.

In another embodiment of the method of the present invention, the particles of nanofiller include an inorganic material consisting mainly of clay.

Further the clay is selected from the group consisting of hydrotalcite, montmorillonite, phyllosilicate, saponite, hectorite, beidellite, stevensite, vermiculite, halloysite, mica, micafluoride, and octosilicate.

In another embodiment of the method of the present invention, the nanofiller is added to the polymer using a concentrate or nanocomposite.

Other features and advantages of the present invention should become apparent from the following detailed description of the preferred embodiments.

DESCRIPTION OF THE PREFERRED EMBODIMENTS

Figure 1:
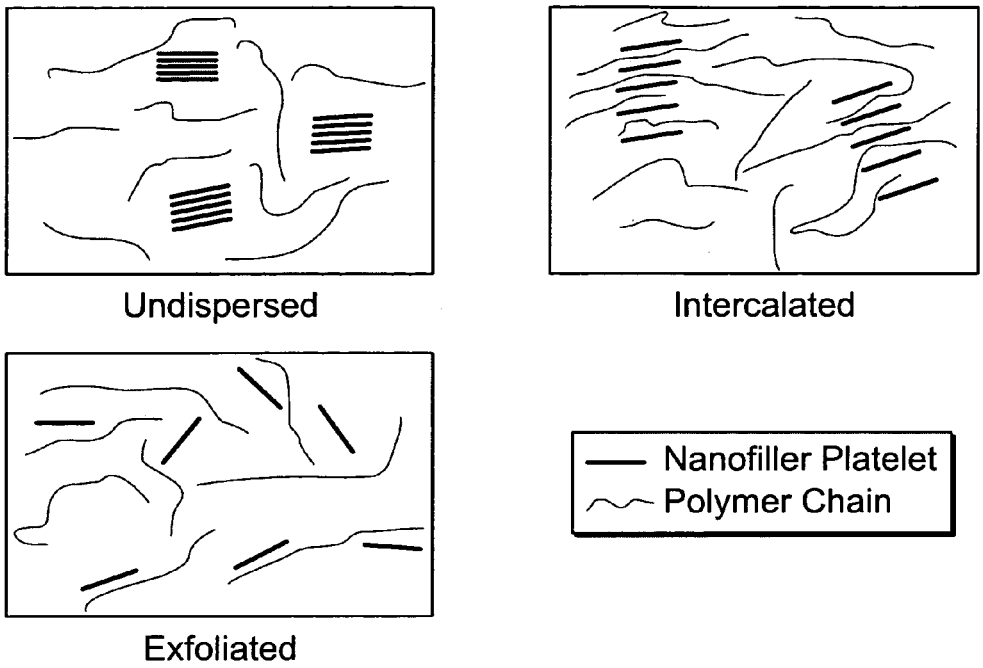
FIG. 1 is a representation of the various dispersion levels for nanofiller in polymers. Undispersed, intercalated, and exfoliated nanofiller dispersions are represented.

Any numerical values recited herein include all values from the lower value to the upper value in increments of one unit provided that there is a separation of at least 2 units between any lower value and any higher value. As an example, if it is stated that the amount of a component or a value of a process variable is from 1 to 90, preferably from 20 to 80, more preferably from 30 to 70, it is intended that values such as 15 to 85, 22 to 68, 43 to 51, 30 to 32 etc. are expressly enumerated in this specification. For values, which have less than one unit difference, one unit is considered to be 0.1, 0.01, 0.001, or 0.0001 as appropriate. Thus all possible combinations of numerical values between the lowest value and the highest value enumerated herein are said to be expressly stated in this application.

The term "(meth)acrylic acid" is intended to mean methacrylic acid and/or acrylic acid.

The term "(meth)acrylate" is intended to mean an ester of methacrylic acid and/or acrylic acid.

The term "partially neutralized" is intended to mean an ionomer with a degree of neutralization of less than 100 percent.

The term "hydrocarbyl" is intended to mean any aliphatic, cycloaliphatic, aromatic, aryl substituted aliphatic, aryl substituted cycloaliphatic, aliphatic substituted aromatic, or cycloaliphatic substituted aromatic groups. The aliphatic or cycloaliphatic groups are preferably saturated. Likewise, the term "hydrocarbyloxy" means a hydrocarbyl group having an oxygen linkage between it and the carbon atom to which it is attached.

As used herein, the term "core" is intended to mean the elastic center of a golf ball. The core may have one or more layers of elastic material, which are usually made of rubbery material such as diene rubbers.

The term "cover layer" is intended to mean any layer(s) in a golf ball disposed over the core. In a two-piece ball the core is covered by one cover layer. In a multi-layer ball, there may be several cover layers around the core. In a multi-layer ball the layers between the outermost cover layer and the core may also be referred to as intermediate or mantle layers.

As used herein, the term "matrix polymer" is intended to mean a polymer to which a nanofiller is added and in which the nanofiller is dispersed.

The term "bimodal polymer" refers to a polymer comprising two main fractions and more specifically to the form of the polymers molecular weight distribution curve, i.e. the appearance of the graph of the polymer weight fraction as function of its molecular weight. When the molecular weight distribution curves from these fractions are superimposed into the molecular weight distribution curve for the total resulting polymer product, that curve will show two maxima or at least be distinctly broadened in comparison with the curves for the individual fractions. Such a polymer product is called bimodal. It is to be noted here that also the chemical compositions of the two fractions may be different.

Similarly the term "unimodal polymer" refers to a polymer comprising one main fraction and more specifically to the form of the polymers molecular weight distribution curve, i.e. the molecular weight distribution curve for the total polymer product shows only a single maximum.

The present invention is embodied in a golf ball incorporating nanofillers and a method of manufacture of such a ball. Nanofillers are nanometer-scale inorganic reinforcing particles, generally made of clay, having a high relative surface area because of their plate-like structure. The present invention is embodied in the use of nanofiller blended into materials conventionally used in making golf balls.

Inorganic nanofiller material generally is made of clay, such as hydrotalcite, phyllosilicate, saponite, hectorite, beidellite, stevensite, vermiculite, halloysite, mica, montmorillonite, micafluoride, or octosilicate. To facilitate incorporation of the nanofiller material into the polymer material, either in preparing nanocomposite materials or in preparing polymer-based golf ball compositions, the clay particles generally are coated or treated by a suitable compatibilizing agent or coupling agent. The compatibilizing or coupling agent allows for superior linkage between the inorganic and organic material, and also can account for the hydrophilic nature of the inorganic nanofiller material and the possibly hydrophobic nature of the polymer. Compatibilizing or coupling agents may exhibit a variety of different structures depending upon the nature of both the inorganic nanofiller material and the target matrix polymer. Non-limiting examples include hydroxy-, thiol-, amino-, epoxy-, carboxylic acid-, ester-, amide-, and siloxy-group containing compounds, oligomers or polymers. The nanofiller materials can be incorporated into the polymer either by dispersion into the particular monomer or oligomer prior to polymerization, or by melt compounding of the particles into the matrix polymer. Examples of commercial nanofillers are various Cloisite grades including 10A, 15A, 20A, 25A, 30B, and NA+ of Southern Clay Products (Gonzales, Tex.) and the Nanomer grades including 1.24TL and C.30EVA of Nanocor, Inc. (Arlington Heights, Ill.).

As mentioned above, the nanofiller particles have an aggregate structure with the aggregates particle sizes in the micron range and above. However, these aggregates have a stacked plate structure with the individual platelets being roughly 1 nanometer (nm) thick and 100 to 1000 nm across. As a result, nanofillers have extremely high surface area, resulting in high reinforcement efficiency to the material at low loading levels of the particles. The sub-micron-sized particles enhance the stiffness of the material, without increasing its weight or opacity and without reducing the material's low-temperature toughness.

As shown in FIG. 1, nanofillers when added into a matrix polymer can be mixed in three ways. In one type of mixing there is dispersion of the aggregate structures within the matrix polymer, but on mixing no interaction of the matrix polymer with the aggregate platelet structure occurs, and thus the stacked platelet structure is essentially maintained. As used herein, this type of mixing is defined as "undispersed".

However, if the nanofiller material is selected correctly, the matrix polymer chains can penetrate into the aggregates and separate the platelets, and thus when viewed by transmission electron microscopy or x-ray diffraction, the aggregates of platelets are expanded. At this point the nanofiller is said to be substantially evenly dispersed within and reacted into the structure of the matrix polymer. This level of expansion can occur to differing degrees. If small amounts of the matrix polymer are layered between the individual platelets then, as used herein, this type of mixing is known as "intercalation".

In some case, further penetration of the matrix polymer chains into the aggregate structure separates the platelets, and leads to a complete breaking up of the platelet's stacked structure in the aggregate and thus when viewed by TEM, the individual platelets are thoroughly mixed throughout the matrix polymer. As used herein, this type of mixing is known as "exfoliated". An exfoliated nanofiller has the platelets fully dispersed throughout the polymer matrix; the platelets may be dispersed unevenly but preferably are dispersed evenly.

While not wishing to be limited to any theory, one possible explanation of the differing degrees of dispersion of such nanofillers within the matrix polymer structure is the effect of the compatibilizer surface coating on the interaction between the nanofiller platelet structure and the matrix polymer. By careful selection of the nanofiller it is possible to vary the penetration of the matrix polymer into the platelet structure of the nanofiller on mixing. Thus, the degree of interaction and intrusion of the polymer matrix into the nanofiller controls the separation and dispersion of the individual platelets of the nanofiller within the polymer matrix. This interaction of the polymer matrix and the platelet structure of the nanofiller is defined herein as the nanofiller "reacting into the structure of the polymer" and the subsequent dispersion of the platelets within the polymer matrix is defined herein as the nanofiller "being substantially evenly dispersed" within the structure of the polymer matrix.

If no compatibilizer is present on the surface of a filler such as a clay, or if the coating of the clay is attempted after its addition to the polymer matrix, then the penetration of the matrix polymer into the nanofiller is much less efficient, very little separation and no dispersion of the individual clay platelets occurs within the matrix polymer.

As used herein, a "nanocomposite" is defined as a polymer matrix having nanofiller intercalated or exfoliated within the matrix. Physical properties of the polymer will change with the addition of nanofiller and the physical properties of he polymer are expected to improve even more as the nanofiller is dispersed into the polymer matrix to form a nanocomposite.

Materials incorporating nanofiller materials can provide these property improvements at much lower densities than those incorporating conventional fillers. For example, a nylon-6 nanocomposite material manufactured by RTP Corporation of Wichita, Kan. uses a 3% to 5% clay loading and has a tensile strength of 11,800 psi and a specific gravity of 1.14, while a conventional 30% mineral-filled material has a tensile strength of 8,000 psi and a specific gravity of 1.36. Because use of nanocomposite materials with lower loadings of inorganic materials than conventional fillers provides the same properties, this use allows products to be lighter than those with conventional fillers, while maintaining those same properties.

Nanocomposite materials are materials incorporating from about 0.1% to about 20%, preferably from about 0.1% to about 15%, and most preferably from about 0.1% to about 10% of nanofiller reacted into and substantially dispersed through intercalation or exfoliation into the structure of an organic material, such as a polymer, to provide strength, temperature resistance, and other property improvements to the resulting composite. Descriptions of particular nanocomposite materials and their manufacture can be found in U.S. Pat. Nos. 5,962,553 to Ellsworth, 5,385,776 to Maxfield e al., and 4,894,411 to Okada et al., herein incorporated by reference. The nanocomposite materials disclosed in these patents are coated with a compatibilizing agent selected from the group consisting of hydroxy-, thiol-, amino-, epoxy-, carboxylic acid-, ester-, amide-, and siloxy-group containing compounds, oligomers, and polymers. Examples of nanocomposite materials currently marketed include M1030D, manufactured by Unitika Limited, of Osaka, Japan, and 1015C2, manufactured by UBE America of New York, N.Y.

When nanocomposites are blended with other polymer systems, the nanocomposite may be considered a type of nanofiller concentrate. However, a nanofiller concentrate may be more generally a polymer into which nanofiller is mixed; a nanofiller concentrate does not require that the nanofiller has reacted and/or dispersed evenly into the carrier polymer.

The organic materials used in the present invention, either as the organic component of the nanocomposite material, or as the matrix polymer material to which nanofiller is added, can be thermoset or thermoplastic resins. Examples of suitable thermoset resins include polybutadiene, polyisoprene, silicone rubber, polyurethane, and epoxy. Examples of suitable thermoplastic resins include both non-ionomeric and ionomeric resins.

Additional examples of suitable thermoplastic resins include polyamide, copolyamide, polyester, copolyester, polycarbonate, polyolefin (including polyoctenylene, available under the tradename Verstenamer® from Degussa), ethylene copolymers with (meth)acrylic acid and (meth) acrylate esters, polyphenylene oxide, polyphenylene sulfide, polyimide, polystyrene, polyvinyl chloride, polyurethane, thermoplastic elastomer, thermoplastic vulcanizates and fluoropolymer. Examples of suitable elastomers include polyester thermoplastic urethane, polyether thermoplastic urethane, copolyetherester elastomer, copolyesterester elastomer, polyamide elastomer, olefinic elastomer, ethylene-vinyl acetate copolymers, rubber-based copolymer, cyclic olefin copolymer, and olefinic thermoplastic elastomer. Examples of olefinic thermoplastic elastomers include metallocene-catalyzed polyolefins, ethylene-octene copolymer, ethylene-butene copolymer, and ethylene-propylene copolymers all with or without controlled tacticity as well as blends of polyolefins having ethyl-propylene-non-conjugated diene terpolymer, rubber-based copolymer, and dynamically vulcanized rubber-based copolymer. Examples of these include products sold under the trade names SANTOPRENE, DYTRON, VISAFLEX, and VYRAM by Advanced Elastomeric Systems of Houston, Tex., and SARLINK by DSM of Haarlen, the Netherlands.

Examples of rubber-based copolymers include multiblock rubber-based copolymers, particularly those in which the rubber block component is based on butadiene, isoprene, or ethylene/butylene. The non-rubber repeating units of the copolymer may be derived from any suitable monomers, including meth(acrylate)esters, such as methyl methacrylate and cyclohexylmethacrylate, and vinyl arylenes, such as styrene. Examples of styrenic copolymers are resins manufactured by Kraton Polymers (formerly of Shell Chemicals) under the trade names KRATON D (for styrene-butadiene-styrene and styrene-isoprene-styrene types) and KRATON G (for styrene-ethylene-butylene-styrene and styrene-ethylene-propylene-styrene types) and Kuraray under the trade name SEPTON. Examples of randomly distributed styrenic polymers include paramethylstyrene-isobutylene (isobutene) copolymers developed by ExxonMobil Chemical Corporation and styrene-butadiene random copolymers developed by Chevron Phillips Chemical Co., The Woodlands, Tex.

Examples of copolyester elastomers include polyether ester block copolymers, polylactone ester block copolymers, and aliphatic and aromatic dicarboxylic acid copolymerized polyesters. Polyether ester block copolymers are copolymers comprising polyester hard segments polymerized from a dicarboxylic acid and a low molecular weight diol, and polyether soft segments polymerized from an alkylene glycol having 2 to 10 atoms. Polylactone ester block copolymers are copolymers having polylactone chains instead of polyether as the soft segments discussed above for polyether ester block copolymers. Aliphatic and aromatic dicarboxylic copolymerized polyesters are copolymers of an acid component selected from aromatic dicarboxylic acids, such as terephthalic acid and isophthalic acid, and aliphatic acids having 2 to 10 carbon atoms with at least one diol component, selected from aliphatic and alicyclic diols having 2 to 10 carbon atoms. Blends of an aromatic polyester and an aliphatic polyester also may be used for these. Examples of these include products marketed under the trade names HYTREL by E.I. du Pont de Nemours and Company, and SKYPEL by S.K. Chemicals of Seoul, South Korea.

Examples of thermoplastic elastomers suitable for use in the present invention include those having functional groups, such as carboxylic acid, maleic anhydride, glycidyl, norbonene, and hydroxyl functionalities. An example of these includes a block polymer having at least one polymer block A comprising an aromatic vinyl compound and at least one polymer block B comprising a conjugated diene compound, and having a hydroxyl group at the terminal block copolymer, or its hydrogenated product. An example of this polymer is sold under the trade name SEPTON HG-252 by Kuraray Company of Kurashiki, Japan. Other examples of these include: maleic anhydride functionalized triblock copolymer consisting of polystyrene end blocks and poly (ethylene/butylene), sold under the trade name KRATON FG 1901X by Shell Chemical Company; maleic anhydride modified ethylene-vinyl acetate copolymer, sold under the trade name FUSABOND by E.I. du Pont de Nemours and Company; ethylene-isobutyl acrylate-methacrylic acid terpolymer, sold under the trade name NUCREL by E.I. du Pont de Nemours and Company; ethylene-ethyl acrylate-methacrylic anhydride terpolymer, sold under the trade name BONDINE AX 8390 and 8060 by Sumitomo Chemical Industries; brominated styrene-isobutylene copolymers sold under the trade name BROMO XP-50 by Exxon Mobil Corporation; and resins having glycidyl or maleic anhydride functional groups sold under the trade name LOTADER by Elf Atochem of Puteaux, France.

Examples of polyamide elastomers include polyether amide elastomers, such as polyether amide block copolymer. Examples of these are sold under the trade name PEBAX by Elf Atochem. Mixtures of all of the above-mentioned resins also can be used in the present invention, as can many other known types of polymer.

Styrenic block copolymers is a copolymer of styrene with either butadiene, isoprene, or a mixture of the two. Additional unsaturated monomers may be added to the structure of the styrenic block copolymer as needed for property modification of the resulting SBC/urethane copolymer. The styrenic block copolymer can be a diblock or a triblock styrenic polymer. Examples of such styrenic block copolymers are described in, for example, U.S. Pat. No. 5,436,295 to Nishikawa et al. The styrenic block copolymer can have any known molecular weight for such polymers, and it can possess a linear, branched, star, dendrimeric or combination molecular structure. The styrenic block copolymer can be unmodified by functional groups, or it can be modified by hydroxyl group, carboxyl group, or other functional groups, either in its chain structure or at one or more terminus. The styrenic block copolymer can be obtained using any common process for manufacture of such polymers. The styrenic block copolymers also may be hydrogenated using well-known methods to obtain a partially or fully saturated diene monomer block.

Urethane is the reaction product of a diol or polyol and an isocyanate, with or without a chain extender. Isocyanates used for making the urethanes of the present invention encompass diisocyanates and polyisocyanates. Examples of suitable isocyanates include the following: trimethylene diisocyanate, tetramethylene diisocyanate, pentamethylene diisocyanate, hexamethylene diisocyanate, ethylene diisocyanate, diethylidene diisocyanate, propylene diisocyanate, butylene diisocyanate, bitolylene diisocyanate, tolidine isocyanate, isophorone diisocyanate, dimeryl diisocyanate, dodecane-1,12-diisocyanate, 1,10-decamethylene diisocyanate, cyclohexylene-1,2-diisocyanate, 1-chlorobenzene-2,4-diisocyanate, furfurylidene diisocyanate, 2,4,4-trimethyl hexamethylene diisocyanate, 2,2,4-trimethyl hexamethylene diisocyanate, dodecamethylene diisocyanate, 1,3cyclopentane diisocyanate, 1,3-cyclohexane diisocyanate, 1,3-cyclobutane diisocyanate, 1,4-cyclohexane diisocyanate, 4,4'-methylenebis(cyclohexyl isocyanate), 4,4'-methylenebis (phenyl isocyanate), 1-methyl-2,4-cyclohexane diisocyanate, 1-methyl-2,6-cyclohexane diisocyanate, 1,3-bis(isocyanato-methyl)cyclohexane, 1,6-diisocyanato-2,2,4,4-tetra-methylhexane, 1,6-diisocyanato-2,4,4-tetra-trimethylhexane, trans-cyclohexane-1,4-diisocyanate, 3-isocyanato-methyl-3,5,5-trimethylcyclohexyl isocyanate, 1-isocyanato-3,3,5-trimethyl-5-isocyanatomethylcyclohexane, cyclohexyl isocyanate, dicyclohexylmethane 4,4'-diisocyanate, 1,4-bis(isocyanatomethyl)cyclohexane, m-phenylene diisocyanate, m-xylylene diisocyanate, m-tetramethylxylylene diisocyanate, p-phenylene diisocyanate, p,p'-biphenyl diisocyanate, 3,3'-dimethyl-4,4'-biphenylene diisocyanate, 3,3'-dimethoxy-4,4'-biphenylene diisocyanate, 3,3'-diphenyl-4,4'-biphenylene diisocyanate, 4,4'-biphenylene diisocyanate, 3,3'-dichloro-4,4'-biphenylene diisocyanate, 1,5-naphthalene diisocyanate, 4-chloro-1,3-phenylene diisocyanate, 1,5-tetrahydronaphthalene diisocyanate, meta-xylene diisocyanate, 2,4-toluene diisocyanate, 2,4'-diphenylmethane diisocyanate, 2,4-chlorophenylene diisocyanate, 4,4'-diphenylmethane diisocyanate, p,p'-diphenylmethane diisocyanate, 2,4-tolylene diisocyanate, 2,6-tolylene diisocyanate, 2,2-diphenylpropane-4,4'-diisocyanate, 4,4'-toluidine diisocyanate, dianisidine diisocyanate, 4,4'-diphenyl ether diisocyanate, 1,3-xylylene diisocyanate, 1,4-naphthylene diisocyanate, azobenzene-4,4'-diisocyanate, diphenyl sulfone-4,4'-diisocyanate, triphenylmethane 4,4',4"-triisocyanate, isocyanatoethyl methacrylate, 3-isopropenyl-α,α-dimethylbenzyl-isocyanate, dichlorohexamethylene diisocyanate, ω,ω'-diisocyanato-1,4-diethylbenzene, polymethylene polyphenylene polyisocyanate, polybutylene diisocyanate, isocyanurate modified compounds, and carbodiimide modified compounds, as well as biuret modified compounds of the above polyisocyanates. Each isocyanate may be used either alone or in combination with one or more other isocyanates. These isocyanate mixtures can include triisocyanates, such as biuret of hexamethylene diisocyanate and triphenylmethane triisocyanate, and polyisocyanates, such as polymeric diphenylmethane diisocyanate.

Polyols used for making the polyurethane in the copolymer include polyester polyols, polyether polyols, polycarbonate polyols and polybutadiene polyols. Polyester polyols are prepared by condensation or step-growth polymerization utilizing diacids. Primary diacids for polyester polyols are adipic acid and isomeric phthalic acids. Adipic acid is used for materials requiring added flexibility, whereas phthalic anhydride is used for those requiring rigidity. Some examples of polyester polyols include poly(ethylene adipate) (PEA), poly(diethylene adipate) (PDA), poly(propylene adipate) (PPA), poly(tetramethylene adipate) (PBA), poly(hexamethylene adipate) (PHA), poly(neopentylene adipate) (PNA), polyols composed of 3-methyl-1,5-pentanediol and adipic acid, random copolymer of PEA and PDA, random copolymer of PEA and PPA, random copolymer of PEA and PBA, random copolymer of PHA and PNA, caprolactone polyol obtained by the ring-opening polymerization of ε-caprolactone, and polyol obtained by opening the ring of β-methyl-δ-valerolactone with ethylene glycol can be used either alone or in a combination thereof. Additionally, polyester polyol may be composed of a copolymer of at least one of the following acids and at least one of the following glycols. The acids include terephthalic acid, isophthalic acid, phthalic anhydride, oxalic acid, malonic acid, succinic acid, pentanedioic acid, hexanedioic acid, octanedioic acid, nonanedioic acid, adipic acid, azelaic acid, sebacic acid, dodecanedioic acid, dimer acid (a mixture), ρ-hydroxybenzoate, trimellitic anhydride, ε-caprolactone, and β-methyl-δ-valerolactone. The glycols includes ethylene glycol, propylene glycol, butylene glycol, pentylene glycol, 1,4-butanediol, 1,5-pentanediol, 1,6-hexanediol, neopentylene glycol, polyethylene glycol, polytetramethylene glycol, 1,4-cyclohexane dimethanol, pentaerythritol, and 3-methyl-1,5-pentanediol.

Polyether polyols are prepared by the ring-opening addition polymerization of an alkylene oxide (e.g. ethylene oxide and propylene oxide) with an initiator of a polyhydric alcohol (e.g. diethylene glycol), which is an active hydride. Specifically, polypropylene glycol (PPG), polyethylene glycol (PEG) or propylene oxide-ethylene oxide copolymer can be obtained. Polytetramethylene ether glycol (PTMG) is prepared by the ring-opening polymerization of tetrahydrofuran, produced by dehydration of 1,4-butanediol or hydrogenation of furan. Tetrahydrofuran can form a copolymer with alkylene oxide. Specifically, tetrahydrofuran-propylene oxide copolymer or tetrahydrofuran-ethylene oxide copolymer can be formed. A polyether polyol may be used either alone or in a mixture.

Polycarbonate polyol is obtained by the condensation of a known polyol (polyhydric alcohol) with phosgene, chloroformic acid ester, dialkyl carbonate or diallyl carbonate. Particularly preferred polycarbonate polyol contains a polyol component using 1,6-hexanediol, 1,4-butanediol, 1,3-butanediol, neopentylglycol or 1,5-pentanediol. A polycarbonate polyol can be used either alone or in a mixture.

Polybutadiene polyol includes liquid diene polymer containing hydroxyl groups, and an average of at least 1.7 functional groups, and may be composed of diene polymer or diene copolymer having 4 to 12 carbon atoms, or a copolymer of such diene with addition to polymerizable α-olefin monomer having 2 to 2.2 carbon atoms. Specific examples include butadiene homopolymer, isoprene homopolymer, butadiene-styrene copolymer, butadiene-isoprene copolymer, butadiene-acrylonitrile copolymer, butadiene-2-ethyl hexyl acrylate copolymer, and butadiene-n-octadecyl acrylate copolymer. These liquid diene polymers can be obtained, for example, by heating a conjugated diene monomer in the presence of hydrogen peroxide in a liquid reactant. A polybutadiene polyol can be used either alone or in a mixture.

As stated above, urethane used within the scope of the present invention also may incorporate chain extenders. Non-limiting examples of these extenders include polyols, polyamine compounds, and mixtures of these. Polyol extenders may be primary, secondary, or tertiary polyols. Specific examples of monomers of these polyols include: trimethylolpropane (TMP), ethylene glycol, 1,3-propanediol, 1,4-butanediol, 1,5-pentanediol, 1,6-hexanediol, propylene glycol, dipropylene glycol, 1,2-butanediol, 1,3-butanediol, 2,3-butanediol, 1,2-pentanediol, 2,3-pentanediol, 2,5-hexanediol, 2,4-hexanediol, 2-ethyl-1,3-hexanediol, cyclohexanediol, and 2-ethyl-2-(hydroxymethyl)-1,3-propanediol.

Suitable polyamines that may be used as chain extenders include primary, secondary and tertiary amines; polyamines have two or more amines as functional groups. Examples of these include: aliphatic diamines, such as tetramethylenediamine, pentamethylenediamine, hexamethylenediamine; alicyclic diamines, such as 3,3'-dimethyl-4,4'-diamino-dicyclohexyl methane; or aromatic diamines, such as 4,4'-methylene bis-2-chloroaniline, 2,2',3,3'-tetrachloro-4,4'-diaminophenyl methane, p,p'-methylenedianiline, p-phenylenediamine or 4,4'-diaminodiphenyl; and 2,4,6-tris (dimethylaminomethyl)phenol. Aromatic diamines have a tendency to provide a stiffer (i.e., having a higher Mooney viscosity) product than aliphatic or cycloaliphatic diamines. A chain extender may be used either alone or in a mixture.

Also included as suitable thermoplastic resins are the various ionomeric resins including copolymer-type ionomers having varied acid contents and degrees of acid neutralization, neutralized by monovalent, bivalent, or polyvalent cations, and also terpolymeric ionomers having a comonomer in the structure having varied acid contents and degrees of acid neutralization, neutralized by monovalent, bivalent, or polyvalent cations. Examples of these include α-olefin/unsaturated carboxylic acid copolymer-type ionomeric resin and terpolymeric resin having a softening comonomer, such as acrylate or methacrylate. The acid moiety is neutralized to form an ionomer by a cation such as lithium, sodium, potassium, magnesium, calcium, barium, lead, tin, zinc, aluminum, or a combination of these. Examples of these resins include those sold under the trade names SURLYN (E.I. du Pont de Nemours and Company., Wilmington, Del.) and IOTEK (ExxonMobil Corp., Houston, Tex.).

Preparation of such ionomers is well known, for example see U.S. Pat. No. 3,264,272 (the entire contents of which are herein incorporated by reference). The ionomer resins have been often utilized in golf ball formulations and have, to a large extent, have replaced balata as a golf ball cover stock material. Generally speaking, commercial ionomers consist of a polymer of a mono-olefin, e.g., an alkene, with an unsaturated mono- or dicarboxylic acid having 3 to 12 carbon atoms. An additional monomer in the form of a mono- or dicarboxylic acid ester may also be incorporated in the formulation as a so-called "softening comonomer".

The incorporated carboxylic acid groups are then neutralized by a basic metal ion salt, to form the ionomer. The metal ions used for neutralization include $Li^+$, $Na^+$, $K^+$, $Zn^{2+}$, $Co^{2+}$, $Ni^{2+}$, $Cu^{2+}$, $Pb^{2+}$ and $Mg^{2+}$, with the $Li^+$, $Na^+$, $Zn^{2+}$, and $Mg^{2+}$ being preferred. The basic metal ion salts include those of for example formic acid, acetic acid, nitric acid, carbonic acid, hydrogen carbonate salts, oxides, hydroxides, and alkoxides.

The first commercially available ionomer resins contained up to 16 weight percent acrylic or methacrylic acid, although even at that time, it was also well known that, as a general rule, further increasing the acid content of these cover materials would also further increase their hardness. Hence, in Research Disclosure 29703, published in January 1989, du Pont first disclosed ionomers based on ethylene/acrylic acid or ethylene/methacrylic acid containing acid contents of greater than 15 weight percent. In this same disclosure, du Pont also taught that such so called "high acid ionomers" had significantly improved stiffness and hardness and thus could be advantageously used in golf ball construction, when used either singly or in a blend with other ionomers.

More recently, high acid ionomers are typically defined as those ionomer resins with acrylic or methacrylic acid units present from 16 wt. % to about 35 wt. % in the polymer. Generally, such a high acid ionomer will have a flexural modulus from about 50,000 psi to about 125,000 psi.

Ionomer resins can further comprise a softening comonomer, which is typically present from about 10 wt. % to about 50 wt. % in the polymer. Such ionomers will have a flexural modulus from about 2,000 psi to about 10,000 psi, and are sometimes referred to as "soft" or "very low modulus" ionomers. Typical softening comonomers include n-butyl acrylate, iso-butyl acrylate, n-butyl methacrylate, methyl acrylate and methyl methacrylate.

Today, there are a wide variety of commercially available ionomer resins based both on copolymers of ethylene and (meth)acrylic acid or terpolymers of ethylene and (meth) acrylic acid and (meth)acrylate, all of which may be used as a component of the balls of the present invention. The properties of these ionomer resins can vary widely due to variations in acid content, softening comonomer content, the degree of neutralization, and the type of metal ion used in the neutralization. The full range commercially available typically includes ionomers of polymers of general formula, E/X/Y, where E is ethylene, X is a softening comonomer such as acrylate or methacrylate present in an amount of from 0 wt. % to about 50 wt. % of the polymer, and Y is acrylic or methacrylic acid present in an amount from about 5 wt. % to about 35 wt. % of the polymer, and wherein the acid moiety is neutralized from about 1% to about 90% to form an ionomer with a cation such as lithium, sodium, potassium, magnesium, calcium, barium, lead, tin, zinc or aluminum, or a combination of such cations.

Other examples of ionomers for use in the present invention are ionomers based on the so-called bimodal ionomers as described in U.S. Pat. No. 6,562,906 (the entire contents of which are herein incorporated by reference). These ionomers are bimodal as they are prepared from blends comprising polymers of different molecular weights. Specifically they include bimodal polymer blend compositions comprising:

a) a high molecular weight component having molecular weight of about 80,000 to about 500,000 and comprising one or more ethylene/α, β-ethylenically unsaturated $C_{3-8}$ carboxylic acid copolymers and/or one or more ethylene, alkyl (meth)acrylate, (meth)acrylic acid terpolymers; the high molecular weight component being partially neutralized with metal ions selected from the group consisting of lithium, sodium, zinc, calcium, magnesium, and a mixture of any these; and b) a low molecular weight component having a molecular weight of about from about 2,000 to about 30,000 and comprising one or more ethylene/α, β-ethylenically unsaturated $C_{3-8}$ carboxylic acid copolymers and/or one or more ethylene, alkyl(meth)acrylate, (meth) acrylic acid terpolymers; the low molecular weight component being partially neutralized with metal ions selected from the group consisting of lithium, sodium, zinc, calcium, magnesium, and a mixture of any these.

One or more so called modified ionomeric polymers, may also be used in the present invention. These so-called "modified ionomers" are described in U.S. Pat. Nos. 6,100,321, 6,329,458 and 6,616,552 and US Patent Publication US 2003/0158312 A1, the entire contents of all of which are herein incorporated by reference.

Specifically, the golf balls of the present invention may comprise one or more unimodal modified ionomeric polymers prepared by mixing a) an ionomeric polymer comprising ethylene, from 5 to 25 weight percent (meth)acrylic acid, and from 0 to 40 weight percent of a (meth)acrylate monomer, the ionomeric polymer neutralized with metal ions selected from the group consisting of lithium, sodium, zinc, calcium, magnesium, and a mixture of any of these, and b) one or more fatty acids or metal salts of the fatty acid, the metal selected from the group consisting of calcium, sodium, zinc, lithium, barium and magnesium and the fatty acid preferably being stearic acid.

An example of such a modified ionomer polymer is du Pont® HPF-1000 available from E.I. du Pont de Nemours and Company.

Other examples of modified ionomeric polymers for use in the present invention are those prepared by modifying (again with one or more metal salts of a fatty or waxy acid) ionomers based on the so-called bimodal ethylene/carboxylic acid polymers as described in U.S. Pat. No. 6,562,906 (the entire contents of which are herein incorporated by reference). These polymers are bimodal as they result from blending two polymers of different molecular weights.

These modified bimodal ionomeric polymers comprise;

c) a high molecular weight component having molecular weight of about 80,000 to about 500,000 and comprising one or more ethylene/α, β-ethylenically unsaturated $C_{3-8}$ carboxylic acid copolymers and/or one or more ethylene, alkyl (meth)acrylate, (meth)acrylic acid terpolymers; the high molecular weight component being partially neutralized with metal ions selected from the group consisting of lithium, sodium, zinc, calcium, magnesium, and a mixture of any of these; and d) a low molecular weight component having a molecular weight of about from about 2,000 to about 30,000 and comprising one or more ethylene/α, β-ethylenically unsaturated $C_{3-8}$ carboxylic acid copolymers and/or one or more ethylene, alkyl(meth)acrylate, (meth) acrylic acid terpolymers; the low molecular weight component being partially neutralized with metal ions selected from the group consisting of lithium, sodium, zinc, calcium, magnesium, and a mixture of any these; and e) from about 5 to about 40 weight percent (based on the total weight of the modified ionomeric polymer) of one or more fatty acids or metal salts of the fatty acid, the metal selected from the group consisting of calcium, sodium, zinc, and lithium, barium and magnesium and the fatty acid preferably being stearic acid.

The fatty acids and salts utilized in the modified unimodal or modified bimodal ionomeric polymers are composed of a chain of alkyl groups containing from about 4 to 75 carbon atoms (usually even numbered) and characterized by a —COOH terminal group. The generic formula for all fatty or waxy acids above acetic acid is $CH_3(CH_2)_xCOOH$, wherein the carbon atom count includes the carboxyl group. The fatty or waxy acids utilized to produce the fatty or waxy acid salts incorporated into the invention may be saturated or unsaturated, and they may be present in either solid, semi-solid or liquid form.

Examples of suitable saturated fatty acids, i.e. fatty acids in which the carbon atoms of the alkyl chain are connected by single bonds, include but are not limited to stearic acid ($C_{18}$, i.e. $CH_3(CH_2)_{16}COOH$), palmitic acid ($C_{16}$, i.e. $CH_3(CH_2)_{14}COOH$), pelargonic acid ($C_9$, i.e. $CH_3(CH_2)_7COOH$) and lauric acid ($Cl_2$, i.e. $CH_3(CH_2)_{10}OCOOH$). Examples of suitable unsaturated fatty acids, i.e. a fatty acid in which there are one or more double bonds between the carbon atoms in the alkyl chain, include but are not limited to oleic acid ($C_{13}$, i.e. $CH_3(CH_2)_7CH{:}CH(CH_2)_7COOH$).

The source of the metal ions used to produce the metal salts of the fatty or waxy acid salts also incorporated into the invention are generally various metal salts which provide the metal ions capable of neutralizing, to various extents, the carboxylic acid groups of the fatty acids. These include the sulfate, carbonate, acetate and hydroxylate salts of zinc, barium, calcium and magnesium.

Since the fatty or waxy acid salts utilized in the invention comprise various combinations of fatty or waxy acids neutralized with a large number of different metal ions, several different types of fatty acid salts may be utilized in the invention, including metal stearates, laureates, oleates, and palmitates, with calcium, zinc, sodium, and magnesium stearate being preferred, and calcium and sodium stearate being most preferred.

The fatty or waxy acid or metal salt of the fatty or waxy acid in the modified unimodal or bimodal ionomeric polymers is present in an amount of from about 5 to about 45, preferably from about 7 to about 35, more preferably from about 8 to about 20 weight percent (based on the total weight of the modified ionomeric polymer).

As a result of the addition of the fatty or waxy acids or one or more metal salts of a fatty or waxy acid, from about 40 to 100, preferably from about 50 to 100, more preferably from about 70 to 100 percent of the acidic groups in the final modified ionomeric polymer composition are neutralized by a metal ion.

In a preferred embodiment the modified ionomeric polymer composition further comprises a zinc neutralized ionomer of a polymer of general formula E/X/Y where E is ethylene, X is a softening comonomer such as acrylate or methacrylate and is present in an amount of from 0 to about 50, preferably 0 to about 25, most preferably 0, and Y is acrylic or methacrylic acid and is present in an amount from about 5 to about 25, preferably from about 10 to about 25, most preferably from about 10 to about 20 wt %.

Most preferred polymer mixtures include thermoplastic elastomer blends with one or more of the group consisting of ionomers, polyolefins including ethylene copolymers with (meth)acrylic acid and ethylene terpolymers with (meth)acrylic acid and (meth)acrylate esters, and polyamides.

Figure 2:
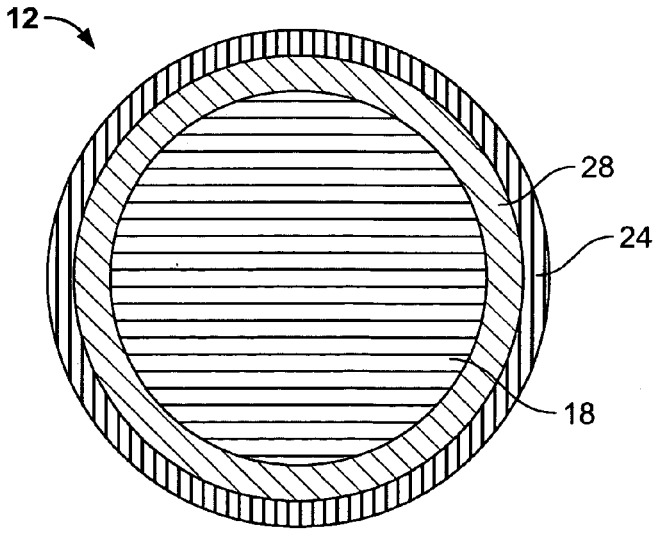
FIG. 2 is a cross-sectional view of a golf ball 12, having a core 18, an intermediate cover layer 28, and an outer cover layer 24.

Referring to now to FIG. 2, there is illustrated a golf ball 12 that includes a solid center or core 18, formed as a solid, spherical body of the formulation described below. This core 18, comprises the following components:

b) Unsaturated Polymer

The core 12 of the golf ball 10 of the present invention comprises an unsaturated polymer. Unsaturated polymers suitable for use in the golf balls of the present invention include any polymeric material having an unsaturation, either hydrocarbon or non-hydrocarbon, capable of participating in a cross-linking reaction initiated thermally, chemically, by irradiation, or by a combination of these methods. The unsaturated polymer can be any rubber commonly used in conventional one-piece golf balls and the cores of multi-layered golf balls. Non-limiting examples of suitable unsaturated polymers include 1,2-polybutadiene, cis-1,4-polybutadiene, trans-1,4-polybutadiene, cis-polyisoprene, trans-polyisoprene, polychloroprene, polybutylene, polyoctenylene (available under the tradename Verstenamer® from Degussa), styrene-butadiene rubber, styrene-butadiene-styrene block copolymer and partially and fully hydrogenated equivalents, styrene-isoprene-styrene block copolymer and partially and fully hydrogenated equivalents, nitrile rubber, silicone rubber, and polyurethane, as well as mixtures of these.

Polybutadiene rubbers, especially 1,4-polybutadiene rubbers containing at least 40 mol %, and more preferably 80 to 100 mol % of cis-1,4 bonds, are preferred, because of their high rebound resilience, moldability, and high strength after vulcanization. The polybutadiene component may be synthesized using rare earth-based catalysts, nickel-based catalysts, or cobalt-based catalysts, as conventionally used in this field.

Polybutadiene obtained using lanthanum rare earth-based catalysts is usually synthesized by polymerizing butadiene in the presence of a catalyst comprising a combination of a lanthanum rare earth compound, an organic aluminum compound, a Lewis base and, when necessary, a Lewis acid. The lanthanum rare earth compound may be a compound containing a rare earth atom (atomic number of 57 to 71), but particularly preferred is a neodymium compound.

Examples of the nickel-based catalysts include one-component types such as nickel diatomaceous earth, two-component types such as Raney-nickel/titanium tetrachloride, and three-component types such as a nickel compound/organic metal/boron trifluoride etherate. Examples of nickel compounds include reduced nickel with carrier, Raney-nickel, nickel oxide, nickel carboxylate, and a complex salt of organic nickel. Examples of the organic metals include a trialkyl aluminum such as triethyl aluminum, tri-n-propyl aluminum, tri-isobutyl aluminum, or tri-n-hexyl aluminum; an alkyl lithium such as n-butyl lithium, sec-butyl lithium, tert-butyl lithium, or 1,4-dibutane lithium; and a dialkyl zinc such as diethyl zinc or dibutyl zinc.

Examples of the cobalt-based catalysts include, as cobalt and compounds thereof, Raney-cobalt, cobalt chloride, cobalt bromide, cobalt iodide, cobalt oxide, cobalt sulfate, cobalt carbonate, cobalt phosphate, cobalt phthalate, cobalt carbonyl, cobalt acetylacetonate, cobalt diethyl dithiocarbamate, cobalt anilinium nitrite, and cobalt dinitrosyl chloride. In particular, each of these compounds is preferably combined with a dialkyl aluminum monochloride such as diethyl aluminum monochloride or diisobutyl aluminum monochloride, a trialkyl aluminum such as triethyl aluminum, tri-n-propyl aluminum, triisobutyl aluminum or tri-n-hexyl aluminum, an aluminum alkyl sesquichloride such as ethyl aluminum sesquichloride, or aluminum chloride.

The 1,4-polybutadiene rubbers have a molecular weight distribution (Mw/Mn) preferably in the range of about 1.2 to about 4.0, more preferably about 1.7 to about 3.7, even more preferably about 2.0 to about 3.5, and most preferably from about 2.2 to about 3.2.

The polybutadiene rubbers have a Mooney viscosity (ML1+4 (100° C.)) in the range of preferably about 20 to about 80, more preferably about 30 to about 70, even more preferably about 35 to about 60, and most preferably about 35 to about 50.

a) Unsaturated Polymer

The 1,4-polybutadiene rubbers may also be blended with natural rubber, polyisoprene rubber, styrene-butadiene rubber, or the like. At least 80% by weight of 1,4-polybutadiene rubber should be present in the base rubber, because base rubbers containing less 1,4-polybutadiene rubber often fail to take advantage of the rebound resilience of the polybutadiene rubber.

Many different types of 1,2 polybutadienes exist, having widely varying physical properties as a result of their differing tacticity, crystallinity, and molecular weight. Examples of 1,2 polybutadienes having differing tacticity, all of which are suitable as unsaturated polymers for use in the present invention, are atactic 1,2 polybutadiene, isotactic 1,2 polybutadiene, and syndiotactic 1,2 polybutadiene. Syndiotactic polymers include alternating base units that are enantiomers of each other. These 1,2 polybutadienes are also differentiated by their crystallinity, which ranges from amorphous 1,2 polybutadienes that essentially lack crystallinity to semi crystalline 1,2 polybutadienes of varying crystallinities. The molecular weights of these 1,2-polybutadienes can also vary greatly. The various combinations of tacticity, crystallinity, and molecular weight provide for many different types of 1,2 polybutadienes having very different processability, as well as other chemical, thermal, mechanical, and rheological properties. Syndiotactic 1,2-polybutadiene having a crystallinity suitable for use as an unsaturated polymer in compositions within the scope of the present invention are polymerized from a 1,2 addition of butadiene. Golf balls within the scope of the present invention include syndiotactic 1,2-polybutadiene having crystallinity and greater than about 70% of 1,2-bonds, more preferably greater than about 80% of 1,2-bonds, and most preferably greater than about 90% of 1,2-bonds. Also, golf balls within the scope of the present invention may include syndiotactic 1,2-polybutadiene having a crystallinity between about 5% and about 50%, more preferably between about 10% and about 40%, and most preferably between about 15% and about 30%. In addition, golf balls within the scope of the present invention may include syndiotactic 1,2-polybutadiene having crystallinity and a mean molecular weight between about 10,000 and about 350,000, more preferably between about 50,000 and about 300,000, more preferably between about 80,000 and about 200,000, and most preferably between about 10,000 and about 150,000. Examples of suitable syndiotactic 1,2-polybutadienes having crystallinity suitable for use in golf balls within the scope of the present invention are sold under the trade names RB810, RB820, and RB830 by JSR Corporation of Tokyo, Japan. These have more than 90% of 1,2 bonds, a mean molecular weight of approximately 120,000, and a crystallinity between about 15% and about 30%.

In one embodiment of the invention, the core 12 may comprise a center and one or more core layers disposed around the center. These core layers may be made from the same rubber as is used in the center portion, or they may be a different elastomer. The various core layers (including the center) may each exhibit a different hardness. The Shore D hardness difference between the center hardness and that of the next adjacent layer, as well as the difference in hardness between the various core layers preferably is greater than 2, more preferably is greater than 5, and most preferably is greater than 10 units.

In one preferred embodiment, the hardness of the center and each sequential layer increases progressively outwards from the center to outer core layer.

In another preferred embodiment, the hardness of the center and each sequential layer decreases progressively outwards from the center to the outer core layer.

In one embodiment of the invention, the core 12 may comprise a center and one or more core layers disposed around the center. These core layers may be made from the same rubber as is used in the center portion, or they may be a different elastomer. The various core layers (including the center) may each exhibit a different specific gravity. The specific gravity difference between the center and that of the next adjacent layer, as well as the difference in specific gravity between the various core layers preferably is greater than 0.1, more preferably is greater than 0.2.

In one preferred embodiment, the specific gravity of the center and each sequential layer increases progressively outwards from the center to outer core layer.

In another preferred embodiment, the specific gravity of the center and each sequential layer decreases progressively outwards from the center to the outer core layer.

c) Cross-Linking Agents

Suitable cross-linking agents for use in the golf balls of the present invention include peroxides, sulfur compounds, or other known chemical cross-linking agents, as well as mixtures of these. Non-limiting examples of suitable cross-linking agents include primary, secondary, or tertiary aliphatic or aromatic organic peroxides. Peroxides containing more than one peroxy group can be used, such as 2,5-dimethyl-2,5-di(tert-butylperoxy)hexane and 1,4-di-(2-tert-butyl peroxyisopropyl)benzene. Both symmetrical and asymmetrical peroxides can be used, for example, tert-butyl perbenzoate and tert-butyl cumyl peroxide. Peroxides incorporating carboxyl groups also are suitable. The decomposition of peroxides used as cross-linking agents in the present invention can be brought about by applying thermal energy, shear, irradiation, reaction with other chemicals, or any combination of these. Both homolytically and heterolytically decomposed peroxide can be used in the present invention. Non-limiting examples of suitable peroxides include: diacetyl peroxide; di-tert-butyl peroxide; dibenzoyl peroxide; dicumyl peroxide; 2,5-dimethyl-2,5-di(benzoylperoxy)hexane; 1,4-bis-(t-butylperoxyisopropyl)benzene; t-butylperoxybenzoate; 2,5-dimethyl-2,5-di-(t-butylperoxy) hexyne-3, such as Trigonox 145-45B, marketed by Akrochem Corp. of Akron, Ohio; 1,1-bis(t-butylperoxy)-3,3,5 tri-methylcyclohexane, such as Varox 231-XL, marketed by R.T. Vanderbilt Co., Inc. of Norwalk, Conn.; and di-(2,4-dichlorobenzoyl)peroxide. The cross-linking agents can be blended in total amounts of about 0.05 part to about 5 parts, more preferably about 0.2 part to about 3 parts, and most preferably about 0.25 parts to about 2 parts, by weight of the cross-linking agents per 100 parts by weight of the unsaturated polymer.

Each cross-linking agent has a characteristic decomposition temperature at which 50% of the cross-linking agent has decomposed when subjected to that temperature for a specified time period ($T_{1/2}$). For example, 1,1-bis-(t-butylperoxy)-3,3,5-tri-methylcyclohexane at $T_{1/}$=0.1 hr has a decomposition temperature of 138° C. and 2,5-dimethyl-2,5-di-(t-butylperoxy)hexyne-3 at $T_{1/}$=0.1 hr has a decomposition temperature of 182° C. Two or more cross-linking agents having different characteristic decomposition temperatures at the same $T_{1/}$ may be blended in the composition. For example, where at least one cross-linking agent has a first characteristic decomposition temperature less than 150° C., and at least one cross-linking agent has a second characteristic decomposition temperature greater than 150° C., the composition weight ratio of the first one cross-linking agent to the second cross-linking agent preferably is in range from 5:95 to 95:5, and more preferably in the range of 10:90 to 50:50.

Besides the use of chemical cross-linking agents, exposure of the composition to radiation also can serve as a cross-linking agent. Radiation can be applied to the unsaturated polymer mixture by any known method, including using microwave or gamma radiation, or an electron beam device. Additives may also be used to improve radiation curing of the diene polymer.

d) Co-Cross-Linking Agent

The rubber and cross-linking agent may be blended with a co-cross-linking agent, which may be an unsaturated carboxylic acid or metal salt of an unsaturated carboxylic acid. Examples of such metal salts include zinc and magnesium salts of unsaturated fatty acids having 3 to 8 carbon atoms, such as acrylic acid, methacrylic acid, maleic acid, fumaric acid, and palmitic acid, with the zinc salts of acrylic and methacrylic acid being most preferred. The unsaturated carboxylic acid metal salt can be blended in a rubber either as a preformed metal salt, or by introducing an α,β-unsaturated carboxylic acid and a metal oxide or hydroxide into the rubber composition, and allowing them to react in the rubber composition to form a metal salt. The unsaturated carboxylic acid metal salt can be blended in any desired amount, but preferably in amounts of about 10 parts to about 60 parts by weight of the unsaturated carboxylic acid per 100 parts by weight of the unsaturated polymer.

e) Peptizer

The compositions used to formulate the cores of the balls of the present invention may also incorporate one or more peptizers. The term "peptizer" is intended to mean chemicals that inhibit cross-linking during the initial processing of unsaturated polymers, but then participate in the cross-linking of the unsaturated polymer after cross-linking has commenced.

The peptizer preferably comprises an organic sulfur compound and/or its metal or non-metal salt. Examples of such organic sulfur compounds include thiophenols, such as pentachlorothiophenol, 4-butyl-o-thiocresol, 4 t-butyl-p-thiocresol, and 2-benzamidothiophenol; thiocarboxylic acids, such as thiobenzoic acid; 4,4' dithio dimorpholine; and, sulfides, such as dixylyl disulfide, dibenzoyl disulfide; dibenzothiazyl disulfide; di(pentachlorophenyl)disulfide; dibenzamido diphenyldisulfide (DBDD), and alkylated phenol sulfides, such as VULTAC marketed by Atofina Chemicals, Inc. of Philadelphia, Pa. Preferred organic sulfur compounds include pentachlorothiophenol and dibenzamido diphenyldisulfide.

Examples of the metal salt of an organic sulfur compound include sodium, potassium, lithium, magnesium, calcium, barium, cesium, and zinc salts of the above-mentioned thiophenols and thiocarboxylic acids, with the zinc salt of pentachlorothiophenol being most preferred.

Examples of the non-metal salt of an organic sulfur compound include ammonium salts of the above-mentioned thiophenols and thiocarboxylic acids, wherein the ammonium cation has the general formula $[NR^1R^2R^3R^4]^+$, where $R^1$, $R^2$, $R^3$, and $R^4$ is either hydrogen, or a $C_1$-$C_{20}$ aliphatic, cycloaliphatic or aromatic moiety, or any and all combinations thereof, with the most preferred being the $NH_4^+$-salt of pentachlorothiophenol.

b) Cross-Linking Agents f) Accelerators

The golf ball composition can comprise one or more accelerators of one or more classes. Accelerators added to an unsaturated polymer increase the vulcanization rate and/or decrease the vulcanization temperature of the unsaturated polymers. Accelerators can be of any class known for rubber processing including mercapto-, sulfenamide-, thiuram, dithiocarbamate, dithiocarbamylsulfenamide, xanthate, guanidine, amine, thiourea, and dithiophosphate accelerators. Specific commercial accelerators include 2-mercaptobenzothiazole and its metal or non-metal salts, such as Vulkacit Mercapto C, Mercapto MGC, Mercapto ZM-5, and ZM marketed by Bayer AG of Leverkusen, Germany, Nocceler M, Nocceler MZ, and Nocceler M-60 marketed by Ouchisinko Chemical Industrial Company, Ltd. of Tokyo, Japan, and MBT and ZMBT marketed by Akrochem Corporation of Akron, Ohio. A more complete list of commercially available accelerators is given in The Vanderbilt Rubber Handbook: 13th Edition (1990, R.T. Vanderbilt Co.), pp. 296-330, in Encyclopedia of Polymer Science and Technology, Vol. 12 (1970, John Wiley & Sons), pp. 258-259, and in Rubber Technology Handbook (1980, Hanser/Gardner Publications), pp. 234-236. Preferred accelerators include 2-mercaptobenzothiazole (MBT) and its salts.

The ball core composition can further incorporate in the range of about 0.1 parts to about 10 parts by weight of the accelerator per 100 parts by weight of the unsaturated polymer. More preferably, the ball composition can further incorporate about 0.2 part to about 5 parts, and most preferably from about 0.5 part to about 1.5 parts, by weight of the accelerator per 100 parts by weight of the unsaturated polymer Golf balls within the scope of the present invention can be prepared by molding the rubber composition as formulated above into a core of desired size and vulcanizing the rubber by heating. The manufacture of these spheres can be in accord with conventional methods and conditions of manufacture. After the cores have been made, the various inner and outer cover layers are then formed over them.

c) Co-Cross-Linking Agent

Similarly, when used in core compositions, nanocomposite materials allow adjustment of the compression ratio and C.O.R. of the resulting core without substantially increasing its hardness. Usually, these properties are adjusted using a curing agent or a co-agent, which also can lead to increased hardness. Use of nanocomposite materials, therefore, allows for increased flexibility in adjusting these properties.

d) Acceleratom

When used in the manufacture of golf balls, nanocomposite materials can be blended effectively into ball compositions to be from about 1% to 50% of the total composition by weight, with a preferred range from about 1% to 40%, and an optimal range of from about 5% to 30% of the total composition by weight. Nanofiller materials can be blended effectively into ball compositions to be from about 0.1% to 20% of the total composition by weight, with a preferred range from about 0.1% to 15%, and an optimal range of from about 0.1% to 10% of the total composition by weight. The nanocomposite and nanofiller materials can also be used in combination. In this case, the materials can be blended effectively into golf ball compositions when the total loading of the nanofiller materials, i.e., the nanofiller material separately added and the nanofiller material incorporated into the nanocomposite material, is within the ranges described above for use of nanofiller material alone. Use of a greater percentage of the nanocomposite or nanofiller materials can make the composition too rigid or brittle, while use of a lesser percentage can make the effect of the nanocomposite or nanofiller material on the physical properties of the composition less apparent. The remainder of the ball composition can be comprised of any of the polymer materials commonly used in golf ball compositions, such as ionomeric and elastomeric resins and block copolymers. Any colorants, stabilizers, antioxidants, processing aids, fillers, or mold release agents commonly used in the manufacture of golf balls also can be blended with nanocomposite or nanofiller materials. During the manufacturing process, the nanocomposite or nanofiller materials can be blended into the other components of the golf ball composition using known techniques, such as compounding and extrusion.

EXAMPLES

Unless otherwise stated, the properties of Tensile Strength, Tensile Elongation, Flexural Strength, Flexural Modulus, PGA compression, C.O.R., Shore D hardness on both the materials and the resulting ball were conducted using the test methods as defined below.

Core or ball diameter was determined by using standard linear calipers or size gauge.

Core specific gravity was determined by electronic densimeter using ASTM D-792, with water as the medium.

Compression is measured by applying a spring-loaded force to the golf ball center, golf ball core, or the golf ball to be examined, with a manual instrument (an "Atti gauge") manufactured by the Atti Engineering Company of Union City, N.J. This machine, equipped with a Federal Dial Gauge, Model D81-C, employs a calibrated spring under a known load. The sphere to be tested is forced a distance of 0.2 inch (5 mm) against this spring. If the spring, in turn, compresses 0.2 inch, the compression is rated at 100; if the spring compresses 0.1 inch, the compression value is rated as 0. Thus more compressible, softer materials will have lower Atti gauge values than harder, less compressible materials. Compression measured with this instrument is also referred to as PGA compression. The approximate relationship that exists between Atti or PGA compression and Riehle compression can be expressed as:

(Atti or PGA compression)=(160-Riehle Compression).

Thus, a Riehle compression of 100 would be the same as an Atti compression of 60.

e) Accelerators

Shore D hardness was measured in accordance with ASTM Test D2240. Hardness of a layer was measured on the ball, perpendicular to a land area between the dimples.

The ball performance was determined using a Robot Driver Test, which utilized a commercial swing robot in conjunction with an optical system to measure ball speed, launch angle, and backspin after a golf ball is hit with a given club. As an example, in the driver test test, a titanium driver is attached to a swing robot and the swing speed and power profile as well as tee location and club lie angle is setup to generate the following values using a Maxfli XS Tour golf ball as a reference:

Headspeed: 112 mph

Ballspeed: 160 mph

Launch Angle: 9 deg

Backspin: 3200 rpm

Then, the test ball was substituted for the reference ball and the corresponding values determined 1) Example 1

Use of nanocomposite materials was tested in golf ball covers. Test golf balls were prepared in which the covers comprised either 10% or 20% by weight of nanocomposite material. The particular nanocomposite material used was M1030D, a polyamide 6-based nanocomposite material manufactured by Unitika, Limited. of Tokyo, Japan. This nanocomposite material is prepared by dispersion of treated nanometer-scale phyllosilicate in the base monomer prior to polymerization. This nanocomposite material has low specific gravity, high modulus and high strength, and therefore it is particularly suitable for use in golf ball cover compositions. Other comparable nanocomposite materials, such as those discussed above, also could be used, depending upon the particular properties to be imparted to the resulting golf ball.

The test balls each had a core having a PGA compression of 70. Over each core was placed a mantle layer having a hardness of 37 on the Shore D scale, a flexural modulus of 9.7 kpsi, and a tensile elongation of 717%. Over each mantle layer was placed a cover layer comprising nanocomposite material and either: PEBAX 3533, a polyether amide block copolymer marketed by Elf Atochem; or Kuraray's Septon HG-252 hydroxy-terminated styrene/ethylene-propylene/styrene block copolymer. Use of a polymer in the nanocomposite material that is in the same polymeric family as the polymer in the remainder of the composition is expected to provide good compatibility between the components. The cover compositions incorporating the nanocomposite material were manufactured using conventional compounding techniques. The particular cover composition percentages of the two ball types are provided below in Table 1.

TABLE 1

Test Ball Cover Compositions

| Cover Composition # | M1030D wt % | PEBAX 3533 wt % | HG-252 wt % |
|---|---|---|---|
| Cover #1 | 10 | 90 | 0 |
| Cover #2 | 20 | 80 | 0 |
| Cover #3 | 10 | 0 | 90 |
| Cover #4 | 20 | 0 | 80 |

Testing

The balls were tested for spin rate and speed when hit with an 8-iron and with a driver and for surface hardness on the Shore D scale. The balls also were tested for shear resistance using a robot to simulate real-life impact conditions at 80 mph club head speed. Three of each type of ball were used for this testing. Each ball was assigned a numerical score from 1 (no visible damage) to 5 (substantial material displaced), and these scores were averaged for each ball type to produce the shear resistance numbers below.

TABLE 2

Performance of Balls

| Ball Type | Cover Hardness (Shore D) | 8 Iron Spin (rpm) | 8 Iron Speed (mph) | Driver Speed (mph) | Shear Resistance |
|---|---|---|---|---|---|
| Test #1 | 29 | 9683 | 110.2 | 158.5 | 3.8 |
| Test #2 | 35 | 9259 | 110.2 | 158.4 | 3.6 |
| Test #3 | 30 | 9652 | 110.0 | 159.2 | 1.7 |
| Test #4 | 35 | 9660 | 110.4 | 159.4 | 1.6 |
| Titleist Professional | 58 | 7685 | 108.7 | 161.6 | 3.2 |
| Titleist Tour Balata | 48 | 8989 | 109.9 | Not tested | 4.8 |
| Titleist HP Tour | 58 | 7708 | 109.4 | Not tested | 1.5 |
| Taylor Made InerGel Pro | 56 | 8140 | 109.4 | 160.9 | 1.3 |
| Taylor Made InerGel Pro Distance | 61 | 7947 | 110.0 | 161.7 | 1.3 |

Results

Each of the test balls demonstrated lower cover hardness and higher 8-iron spin rate than any of the marketed balls tested. As discussed above, high spin rate is desirable because it allows for improved control of the ball when hit. Low ball cover hardness provides for improved ball feel when hit. The test balls also demonstrated 8-iron speeds higher than or roughly equal to that of the marketed balls, despite the fact that low ball hardness generally leads to reduced ball speed. High ball speed is desirable because it leads to greater flying distance of the ball when hit. Balls of the present invention, therefore, overcome design limitations previously known in the manufacture of golf balls, i.e., that softer ball covers generally provide reduced ball speeds. Balls of the present invention provide good spin rate and feel, as well as good distance performance.

Additionally, the test balls demonstrated shear resistance, and therefore durability, either comparable to or superior to that of a number of the marketed balls. In particular, test balls 1 and 2 demonstrated shear resistance comparable to that of the Titleist Professional and Tour Balata balls, even though the test balls had a far lower cover hardness. Typically, low cover hardness leads to poor shear resistance. Test balls 1 and 2, however, exhibited a combination of a soft cover and durability superior to the Professional and Tour Balata balls. Test balls 3 and 4, which incorporated the HG-252 material, exhibited even better shear resistance than test balls 1 and 2, while maintaining low cover hardness. Test balls 3 and 4 exhibited shear resistance comparable to the Titleist HP Tour and Taylor Made InerGel Pro and ProDistance balls, even though cover hardnesses for test balls 3 and 4 were far lower. Overall, the test results for shear resistance indicate that balls of the present invention provide for a combination of low cover hardness and high shear resistance in comparison to balls currently available. This combination allows balls to be made that are exhibit good feel and also are durable.

Generally, it is difficult to produce golf balls having high short iron spin rate, long distance when hit, good feel, and good durability. The test balls incorporating nanocomposite material exhibited all of these. The performance of the test balls demonstrates the superiority of the nanocomposite blends in maximizing ball properties that, using conventional methods, tend to relate inversely to each other.

2) Example 2

The use of nanofillers in ionomers was tested in golf ball covers. The test balls each had a 1.58" diameter core having a PGA compression of 70. Over each core was injection molded a cover layer comprising ionomer filled with varying levels of Cloisite NA nanofiller from Southern Clay Products (Gonzales, Texas). The ionomer composition was a blend of two high acid copolymer ionomers (8140 and 9120) and one terpolymer ionomer (8320) from the commercial Surlyn product line of du Pont; Surlyn 8140 and 9120 were 25% of the ionomer blend each with Surlyn 8320 being 50%. A 50% color concentrate in a high acid copolymer ionomer was also used. The ionomeric cover compositions incorporating the nanofiller were manufactured using conventional twin-screw compounding techniques. The particular cover compositions tested are provided below in Table 3.

TABLE 3

| Material # | Surlyn Blend (pph) | Surlyn Color Concentrate (pph) | Cloisite NA (pph) |
|---|---|---|---|
| 1 | 100 | 5 | 0 |
| 2 | 100 | 5 | 1 |
| 3 | 100 | 5 | 4 |
| 4 | 100 | 5 | 7 |

Testing

The materials were molded into flexural test bars and 1.480" spheres. The flex bars were tested following ASTM D 790 for flexural testing. The spheres were tested for both Shore D hardness of the surface and for Atti compression. Shore D hardness was performed following ASTM D2240 guidelines except the hardness was measured on the curved surface of the sphere. The results of this testing are in Table 4.

The molded balls were tested for surface hardness on the Shore D scale and for the launch angle when the ball was hit by a driver at 160 mph. Three of each type of ball were used for this testing. The results of this testing are in Table 5.

TABLE 4

| Material # | Flexural Modulus, kpsi | Shore D Hardness (sphere) | Atti Compression |
|---|---|---|---|
| 1 | 27.8 | 55.9 | 127 |
| 2 | 27.9 | 56.5 | 127 |
| 3 | 28.8 | 58.7 | 132 |
| 4 | 30.2 | 58.8 | 134 |

TABLE 5

| Material # | Cover Hardness (Shore D) | C.O.R. |
|---|---|---|
| 1 | 54.7 | 0.814 |
| 2 | 55.5 | 0.814 |
| 3 | 57.3 | 0.814 |
| 4 | 56.2 | 0.813 |

Results

As the nanofiller level in ionomer increases, the flexural modulus, Shore D hardness and Atti compression increase. When the ionomers are molded onto golf ball cores, this translates into increased cover hardness while the Coefficient of Restitution (C.O.R.) of the ball is not affected.

The addition of nanofiller to ionomers increases the flexibility for tailoring the surface hardness (and thus the feel) of a golf ball while not affecting the C.O.R. and thus the distance of a golf ball.

Example 3

The use of nanofillers in ionomer/TPE blends was tested in golf ball covers. The test balls each had a 1.58" diameter core having a PGA compression of 70. Over each core was injection molded a cover layer comprising ionomer/TPE blend filled with varying levels of Cloisite NA nanofiller from Southern Clay Products (Gonzales, Tex.). The ionomer was a high acid copolymer ionomer (Surlyn 6120) from the commercial Surlyn product line of du Pont and the TPE was Kuraray's Septon HG-252 hydroxy-terminated styrene/ethylene-propylene/styrene block copolymer. The ionomer: TPE ratio was 60:40. A 50% color concentrate in a high acid copolymer ionomer was also used. Additionally, Atofina's Lotader AX8920 and Rohm & Haas' Paraloid EXL-2691A were added to the blend. The cover compositions incorporating the nanofiller were manufactured using conventional twin-screw compounding techniques. The particular cover compositions tested are provided below in Table 6.

TABLE 6

| Material # | Surlyn/TPE Blend (pph) | Surlyn Color Concentrate (pph) | Cloisite NA (pph) | Lotader AX8920 (pph) | Paraloid EXL-2691A (pph) |
|---|---|---|---|---|---|
| 1 | 100 | 5 | 0 | 2 | 2 |
| 2 | 100 | 5 | 1 | 2 | 2 |
| 3 | 100 | 5 | 4 | 2 | 2 |
| 4 | 100 | 5 | 7 | 2 | 2 |

Testing

The materials were molded into flexural test bars and 1.480" spheres. The flex bars were tested following ASTM D 790 for flexural testing. The spheres were tested for Shore D hardness of the surface. Shore D hardness was performed following ASTM D2240 guidelines except the hardness was measured on the curved surface of the sphere. The molded balls made from each of the materials were also tested for surface hardness on the Shore D scale; three of each type of ball were used for this testing. The results of this testing are in Table 7.

TABLE 7

| Material # | Flexural Modulus, kpsi | Shore D Hardness (sphere) | Shore D Hardness (ball) |
|---|---|---|---|
| 1 | 14.1 | 42.8 | 44.8 |
| 2 | 15.8 | 42.8 | 44.6 |
| 3 | 16.0 | 44.0 | 45.2 |
| 4 | 16.0 | 45.2 | 46.1 |

Results

As the nanofiller level in ionomer/TPE blends increases, the flexural modulus and the Shore D hardness of the material increase. When the ionomers are molded onto golf ball cores, this translates into increased cover hardness which change the feel of the ball when hit.

The addition of nanofiller to ionomer/TPE blends increases the flexibility for tailoring the surface hardness (and thus the feel) of a golf ball while not affecting the C.O.R. and thus the distance of a golf ball.

Example 4

The addition of nanofiller in thermoplastic polyurethane (TPU) was tested using ASTM methods for flexural modulus and Shore D hardness. The TPU compositions incorporating the nanofiller were manufactured using conventional twin-screw compounding techniques. The three TPUs tested were commercial polyester polyurethanes available from Noveon Corp. (Cleveland, Ohio). When used, the nanofiller was loaded at 7 pph of the TPU and was Nanomer 1.24TL from Nanocor, Inc. (Arlington Heights, Ill.). The particular compositions tested are provided below in Table 8.

TABLE 8

| Material # | TPU | Nanomer 1.24 TL (pph) | Flexural Modulus (kpsi) | Shore D (Hardness) |
|---|---|---|---|---|
| 1 | 100 | | 12.6 | 48 |
| 2 | 100 | 7 | 16.1 | 52 |
| 3 | 100 | | 8.8 | 43 |
| 4 | 100 | 7 | 11.6 | 45 |
| 5 | 100 | | 9.1 | 48 |
| 6 | 100 | 7 | 13.7 | 47 |

Testing

The materials were molded into flexural test bars using a 50-ton Van Dorn injection molding machine. The flex bars were tested following ASTM D 790 for flexural testing. Shore D hardness was performed following ASTM D2240 guidelines with the 0.125" thick flex bars stacked two high. The results of this testing are in Table 8.

Results

The addition of nanofiller to TPU increases the flexural modulus and the Shore D hardness of the material. When the nanofiller containing TPUs are molded onto golf ball cores, this should translate into increased cover hardness which changes the feel of the ball when hit.

The addition of nanofiller to TPU increases the flexibility for tailoring the surface hardness (and thus the feel) of a golf ball.

Example 5

The effect of nanofiller in ethylene-acrylic acid (EAA)/TPE blends on material properties was tested. The material was made in three passes using a conventional twin-screw extruder. In the first extrusion pass, a mixture of 50% Primacor 5980I EAA from Dow Chemical (Midland, Mich.) and 50% Kuraray's Septon HG-252 hydroxy-terminated styrene/ethylene-propylene/styrene block copolymer TPE was compounded with 10 pph (as a function of the EAA/TPE content) AX3410 ethylene-methyl acrylate-glycidyl methacrylate resin from Atofina Chemical (Puteaux, France) and if needed, 1.5 pph Nanomer 1.24TL from Nanocor. In the second extrusion pass, enough magnesium hydroxide was added to the once compounded extrudate to achieve 70% neutralization and in the third extrusion pass, 5 pph 12-aminododecanoic acid was added.

Testing

The thrice-compounded and dried materials were molded into tensile and flexural test bars and 1.480" spheres. The Type IV tensile bars were tested following ASTM D638 for tensile testing. The flex bars were tested following ASTM D 790 for flexural testing and were also used for ASTM D2240 Shore D hardness testing. The spheres were tested for Atti compression, C.O.R., and Shore D hardness of the surface. Shore D hardness was performed following ASTM D2240 guidelines except the hardness was measured on the curved surface of the sphere. Melt flow testing was performed according to ASTM D1238 at 230 degC and 2.16 kg load. The results of this testing are in Table 9.

TABLE 9

| Sample | 1 | 2 |
|---|---|---|
| Nanofiller present | Yes | No |
| Melt Flow Index (g/10') | 20 | 26 |
| Tensile Strength (psi) | 1660 | 1640 |
| Tensile Elongation (%) | 520 | 440 |
| Flexural Modulus (kpsi) | 8.3 | 7.7 |
| Shore D Hardness | 43 | 44 |
| Atti Compression | 94 | 90 |
| C.O.R. | 0.589 | 0.575 |
| Shore D Hardness (Sphere) | 50 | 50 |

Results

Addition of nanofiller to EAA/TPE blends increases the tensile and flexural properties of the material as well as increases the compression and C.O.R. of a sphere without changing the material hardness. The addition of nanofiller to ionomer/TPE blends increases the flexibility for maintaining the surface hardness (and thus the feel) of a golf ball while increasing the C.O.R. and compression and thus the distance of a golf ball. The improved tensile and flexural properties may also lead to improved shear cut resistance if the material were used for the golf ball cover.

Example 6

The use of nanofillers in ionomer/TPE blends was tested in golf ball covers. The test balls each had a 1.48" diameter core having a PGA compression of 50. Over each core was injection molded a 0.05" thick mantle layer of an ionomer composition that was a blend of two high acid copolymer ionomers (Surlyn 8140 and Surlyn 9120) and one terpolymer ionomer (Surlyn 8320) from the commercial Surlyn product line of du Pont; Surlyn 8140 and Surlyn 9120 were 30% of the ionomer blend each with Surlyn 8320 being 40%. A 50% color concentrate in a high acid copolymer ionomer was also used. Over the mantle layer, the ionomer/TPE blends of Table 10 were molded as covers which were then painted and tested for properties. The ionomeric mantle and the ionomer/TPE cover compositions incorporating the nanofiller were manufactured using conventional twin-screw compounding techniques.

TABLE 10

| Material # | HG-252 (pph*) | Surlyn 6120 (pph) | MBS (pph) | EMAA-GMA (pph) | Cloisite 30B (pph) | Cloisite 30/EVA** (pph) |
|---|---|---|---|---|---|---|
| 1 | 50 | 50 | 2 | 2 | — | — |
| 2 | 60 | 40 | 2 | 2 | — | — |
| 3 | 50 | 50 | 2 | 2 | 1.5 | — |
| 4 | 50 | 50 | 2 | 2 | 3 | — |
| 5 | 50 | 50 | 2 | 2 | — | 3 |
| 6 | 60 | 40 | 2 | 2 | — | 3 |

*pph = parts per hundred of base polymer
**50% masterbatch of Cloisite 30B in EVA Testing The molded balls were tested for surface hardness on the Shore D scale, 30 yard pitching wedge spin and speed and also for shear resistance. Three of each type of ball were used for this testing. The results of this testing are shown in Table 11.

TABLE 11

| Cover Material | Cover Hardness (Shore D) | 30 Yard PW* Spin (rpm) | 30 Yard PW Speed (mph) | Shear Resistance |
|---|---|---|---|---|
| #1 | 57.5 | 6820 | 41.9 | 2.2 |
| #2 | 55.9 | 7100 | 42.1 | 1.6 |
| #3 | 49.6 | 7060 | 44.5 | 2.4 |
| #4 | 52.9 | 6960 | 44.3 | 2.5 |
| #5 | 50.2 | 6980 | 44.4 | 2.5 |
| #6 | 49.5 | 7250 | 44.9 | 1.7 |

*PW = pitching wedge

Results

When nanofiller is added to ionomer/TPE blends, the 30 yard pitching wedge spin and speed increases, the shear resistance remains constant, and in this instance, the surface hardness is decreased. The addition of nanofiller to ionomer/TPE blends increases the flexibility for tailoring the properties of a golf ball able to be attained with the blend.

Although the invention has been disclosed in detail with reference only to the preferred embodiments, those skilled in the art will appreciate that additional compositions for ball covers comprising nanocomposite and/or nanofiller materials can be made without departing from the scope of the invention.

We claim:

1. A golf ball comprising:

1) a core; a 2) an intermediate layer; and 3) a cover layer;

wherein the core comprises:

a) a matrix polymer selected from the group consisting of thermoplastics, thermosets and combinations thereof, b) particles of one or more nanofillers, and c) a compatibilizing agent coated on the surfaces of the nanofiller particles, selected to ensure that the nanofiller particles are substantially evenly dispersed in said matrix polymer.

2. The golf ball according to claim 1, wherein said nanofiller particles are present in an amount between about 0.1% and about 20% by weight.

3. The golf ball according to claim 1, wherein said nanofiller particles are present in an amount between about 0.1% and about 15% by weight.

4. The golf ball according to claim 1, wherein said nanofiller particles are present in an amount between about 0.1% and about 10% by weight.

5. The golf ball according to claim 1, wherein said nanofiller particles are present in an amount between about 0.5% and about 5% by weight.

6. The golf ball according to claim 1, wherein said nanofiller particles comprise particles of inorganic material, wherein each particle has a largest dimension that is about one micron or less and that is at least an order of magnitude greater than such particle's smallest dimension.

7. The golf ball according to claim 1, wherein said nanofiller particles comprise clay.

8. The golf ball according to claim 7, wherein the clay is selected from the group consisting of hydrotalcite, montmorillonite, phyllosilicate, micafluoride, and octosilicate.

9. The golf ball according to claim 1, wherein the core includes:

an inner core; and an outer core encasing the inner core.

10. The golf ball according to claim 1, further comprising an ingredient selected from the group consisting of stabilizers, antioxidants, colorants, mold releasing agents, processing aids, and fillers.

11. The golf ball according to claim 1, wherein the core composition comprises an ingredient selected from the group of polybutadiene, polyisoprene, silicone rubber, polyurethane, styrene-butadiene-styrene, styrene-isoprene-styrene, styrene-ethylene-butylene-styrene, and styrene-ethylene-propylene-styrene.

12. The golf ball according to claim 11, wherein the core composition further comprises one or more peptizers, and wherein the peptizer is a non-metal salt of pentachlorothiophenol.

13. The golf ball according to claim 12, wherein the core composition comprises greater than about 0.1 parts by weight of the peptizer per 100 parts by weight of the unsaturated polymer.

14. The golf ball according to claim 12, wherein the core composition comprises greater than about 0.5 parts by weight of the peptizer per 100 parts by weight of the unsaturated polymer.

15. The golf ball according to claim 12, wherein the peptizer is selected from the group consisting of an amine salt of pentachlorothiophenol, an ammonium salt of pentachlorothiophenol, and mixtures thereof.

16. The golf ball according to claim 1, wherein said core comprises a center and one or more layers disposed around said center, and wherein the difference between a hardness of one layer and the next adjacent layer is greater than 2, units Shore D.

17. The golf ball of claim 16, wherein the hardness decreases outwards from the center to the outer core layer.

18. The golf ball according to claim 1, wherein at least one of the cover layer and the intermediate layer comprises polyamide, ionomer, polycarbonate, thermoplastic polyurethane, thermoset polyurethane, polystyrene, fluoropolymer, polyamide elastomer, polyester elastomer, polvoctenylene, polyester, polyolefin, ethylene copolymers with (meth) acrylic acid, ethylene terpolymers with (meth)acrylic acid and (meth) acrylate esters, thermoplastic elastomer, thermoplastic vulcanizate, epoxy resin, and mixtures thereof.

19. The golf ball according to claim 18, wherein the thermoplastic elastomer is a block copolymer comprising:

a first polymer block comprising an aromatic vinyl compound; and a second polymer block comprising a conjugated diene compound.

20. The golf ball according to claim 18, wherein the thermoplastic elastomer is the hydrogenation product of a block copolymer, comprising:

polymer end blocks comprising an aromatic vinyl compound;

a middle polymer block comprising a conjugated diene compound; and hydroxyl groups located at a terminal block copolymer.

21. The golf ball according to claim 18, wherein the ionomer comprises one or more modified ionomers containing fatty acid or the metal salts thereof.

22. The golf ball according to claim 21, wherein the modified ionomer is selected from the group consisting of modified unimodal ionomers, modified bimodal ionomers, and combinations thereof.

* * * * *